US007726010B2

(12) United States Patent
Hsu et al.

(10) Patent No.: US 7,726,010 B2
(45) Date of Patent: Jun. 1, 2010

(54) METHOD OF FORMING A MICRO-ELECTROMECHANICAL (MEMS) SWITCH

(75) Inventors: Louis C. Hsu, Fishkill, NY (US); Lawrence A. Clevenger, Lagrangeville, NY (US); Timothy J. Dalton, Ridgefield, CT (US); Carl J. Radens, Lagrangeville, NY (US); Keith Kwong Hon Wong, Wappingers Falls, NY (US); Chih-Chao Yang, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 22 days.

(21) Appl. No.: 11/968,896

(22) Filed: Jan. 3, 2008

(65) Prior Publication Data

US 2008/0092367 A1 Apr. 24, 2008

Related U.S. Application Data

(62) Division of application No. 11/217,163, filed on Sep. 1, 2005, now Pat. No. 7,394,332.

(51) Int. Cl.
*H01H 11/00* (2006.01)
*H01H 65/00* (2006.01)

(52) U.S. Cl. ..... 29/622; 29/602.1; 29/842; 200/209; 200/210; 200/214; 335/52; 335/60

(58) Field of Classification Search ..... 29/622, 29/602.1, 842; 200/209, 210, 214; 335/52, 335/58, 60

See application file for complete search history.

(56) References Cited

U.S. PATENT DOCUMENTS

| | | | | |
|---|---|---|---|---|
| 7,215,229 | B2 | 5/2007 | Shen et al. | |
| 7,234,233 | B2 * | 6/2007 | Fong et al. | 29/842 |
| 7,250,838 | B2 | 7/2007 | Shen et al. | |
| 7,265,429 | B2 * | 9/2007 | Wan | 257/415 |
| 2003/0156451 | A1 | 8/2003 | Tamura et al. | |
| 2004/0050674 | A1 | 3/2004 | Rubel | |

FOREIGN PATENT DOCUMENTS

| | | |
|---|---|---|
| KR | 0552659 | 2/2006 |
| KR | 0642235 | 11/2006 |

* cited by examiner

*Primary Examiner*—Thiem Phan
(74) *Attorney, Agent, or Firm*—H. Daniel Schnurmann

(57) ABSTRACT

A method of fabricating a MEMS switch having a free moving inductive element within in micro-cavity guided by at least one inductive coil. The switch consists of an upper inductive coil at one end of a micro-cavity; optionally, a lower inductive coil; and a free-moving inductive element preferably made of magnetic material. The coils are provided with an inner permalloy core. Switching is achieved by passing a current through the upper coil, inducing a magnetic field unto the inductive element. The magnetic field attracts the free-moving inductive element upwards, shorting two open conductive wires, closing the switch. When the current flow stops or is reversed, the free-moving magnetic element drops back by gravity to the bottom of the micro-cavity and the conductive wires open. When the chip is not mounted with the correct orientation, the lower coil pulls the free-moving inductive element back at its original position.

15 Claims, 10 Drawing Sheets

METHOD OF FORMING A MICRO-ELECTROMECHANICAL (MEMS) SWITCH

RELATED PATENT APPLICATIONS

This is a Divisional application of U.S. patent application Ser. No. 11/217,163 filed Sep. 1, 2005, now issued as U.S. Pat. No. 7,394,332.

BACKGROUND OF THE INVENTION

The present invention relates to a method of fabricating a micro-electro-mechanical (MEM) device having a switching mechanism that is based on induced a magnetic force and a method of fabricating such a device.

MEM switches are superior to conventional transistor devices in view of their low insertion loss and excellent on/off electrical characteristics. Switches of this kind are finding their way into an increasing number of applications, particularly in the high frequency arena.

By way of example, U.S. Pat. No. 5,943,223 to Pond described a MEM switch that reduces the power loss in energy conversion equipment, wherein MEM devices switch AC to AC converters, AC to DC converters, DC to AC converters, matrix converters, motor controllers, resonant motor controllers and other similar devices.

Known in the art are MEM switches that are designed using a variety of configurations which are well adapted to perform optimally in many different applications.

For instance, U.S. Pat. No. 6,667,245 to Chow et al. describes a cantilever type MEM switch illustrated in FIG. 18, consisting of: 1) upper plate 71; (2) lower plate 74; (3) lower contact 19; (4) upper contact 29; (5) interconnect plug 27 and (6) cantilever 72. When current flows between upper plate 71 and lower plate 74, an electrostatic force is established, attracting upper plate 71 and bending cantilever 72 downwards toward 14, making contact between two contact points 19 and 29.

Another configuration uses a torsion beam, as described in U.S. Pat. No. 6,701,779 B2 to Volant et al., of common assignee. The perpendicular torsion micro-electro-mechanical switch, illustrated in FIGS. 19A and 19B, respectively show a side view and a top-down view thereof. It depicts a switch consisting of five key elements; 1) movable contact 20; (2) stationary contact 30; (3) stationary first control electrode 40; (4) flexible second control electrodes 50 and 50A; and (5) torsion beam 60. Electrodes 40 and 50 are attracted to each other when a DC voltage is applied therebetween, causing torsion beam 60 to bend. Since the movable contact 20 is attached to torsion beam 60, it will, likewise, move downward, making contact to the stationary contact 30.

In yet another configuration, a micro-electromechanical inductive coupling force switch is described in U.S. Pat. No. 6,831,542 B2, of common assignee, and illustratively shown in FIG. 20. The MEM device consists of at least five elements: 1) movable coil assembly 10; (2) moveable inductor coils 20 and 30 rotating around pivot pin 75; (3) stationary coils 40 and 50; (4) comb drives 8 and 9; and (5) conductors coupled to the moveable inductor coils 20 and 30. The coupling force of the coils (20 and 40, 30 and 50 can either be negligible or very strong depending on the position of the assembly which is adjusted by comb drives 8 and 9). In its fully coupled condition, current flowing into coil 40 induces a current into inductor coil 20. Since inductor coils 20 and 30 are interconnected, the same current will flow to 30, which in turn induces a current in stationary coil 50.

A further configuration, described in U.S. Pat. No. 6,452,124 B1 to York et al., shows a capacitive membrane MEM device illustrated in FIG. 21. Therein, a MEM switch is shown consisting of four basic elements: 1) upper metal electrode 102; (2) lower metal electrode 104; (3) insulator membrane 108; and (4) metal cap 110. When a DC voltage potential is applied between 102 and 104, electrode 102 bends downward and makes contact with metal cap 110, closing the switch.

Magnetic coupling providing an angular displacement for actuating micro-mirrors is described in U.S. Pat. No. 6,577,431 B2 to Pan et al. This assembly is illustrated in FIGS. 22A and 22B, respectively showing a perspective view and a side view thereof. It consists of three basic elements: 1) reflection mirror 44; (2) orientation mirror 43; and (3) permalloy material 441 and 431. When current passes through actuator 46, the two permalloy elements induce a magnetic field, creating a repulsing force and bending the mirrors away from the substrate. Both the reflection mirror 44 and the orientation mirror 43 are supported by way of 42*a* onto a glass or silicon substrate 41.

Other related patents include:

U.S. Pat. No. 6,166,478 to Yi et al. which describes a micro-electro-mechanical system that uses magnetic actuation by way of at least two hinged flaps, each having a different amount of permalloy or other magnetic material.

U.S. Pat. No. 5,945,898 to Judy et al. describes a magnetic micro-actuator having a cantilever element supported by at least one mechanical attachment that makes it possible to change the orientation of the element and of at least one layer of magnetically active material placed on one or more regions of the cantilever.

U.S. Pat. No. 6,542,653B2 to Wu et al. describes a micro-switch assembly involving a plurality of latching mechanisms.

Still missing and needed in the industry is a low cost, highly reliable MEM switch that is compatible with CMOS fabrication techniques but which dispenses with the need for large open cavities which are difficult to cover, and even harder to properly planarize. There is a further need in the industry that this MEM switch be hinge free, i.e., devoid of mechanical moving parts in order to achieve durable and reliable switching.

OBJECTS AND SUMMARY OF THE INVENTION

Accordingly, it is an object of the invention to provide of fabricating a micro-cavity MEMS (hereinafter MC-MEMS) which can be fully integrated in a CMOS semiconductor manufacturing line.

It is another object to provide an MC_MEM switch that eliminates the need for large open-surface cavities.

It is still another object to provide a highly reliable and durable MC-MEMS free of moving mechanical hinge elements enclosed in vacuum.

In one aspect of the invention, there is provided a method of forming micro-electromechanical switch that includes: forming on a substrate at least one inductive coil surrounding an inductive element; and etching a micro-cavity in the substrate having an opening substantially aligned with the inductive element, the inductive element moving freely within the cavity, the inductive element moving to a first position when energized by the at least one inductive coil, electrically shorting two conductive wires, and the inductive element moving to a second position when de-energized, opening the two shorted conductive wires, the inductive element when de-energized falling from the first position to the second position by gravity.

The invention further provides a MEM switch which is based on an induced magnetic force, and which includes unique features such as:

a) no portion of the switching device is exposed to the open surface;

b) the switching element is not physically attached to any other part of the switching device;

c) the free moving switch element is embedded within a small cavity of the same shape and size of metal studs used for BEOL (Back-end of the line) interconnections; and d) the switch element moves within the cavity, wherein its motion is controlled by an induced magnetic force.

BRIEF DESCRIPTION OF THE DRAWINGS

These and other objects, aspects and advantages of the invention will be better understood from the detailed preferred embodiment of the invention when taken in conjunction with the accompanying drawings.

DETAILED DESCRIPTION

Figure 1:
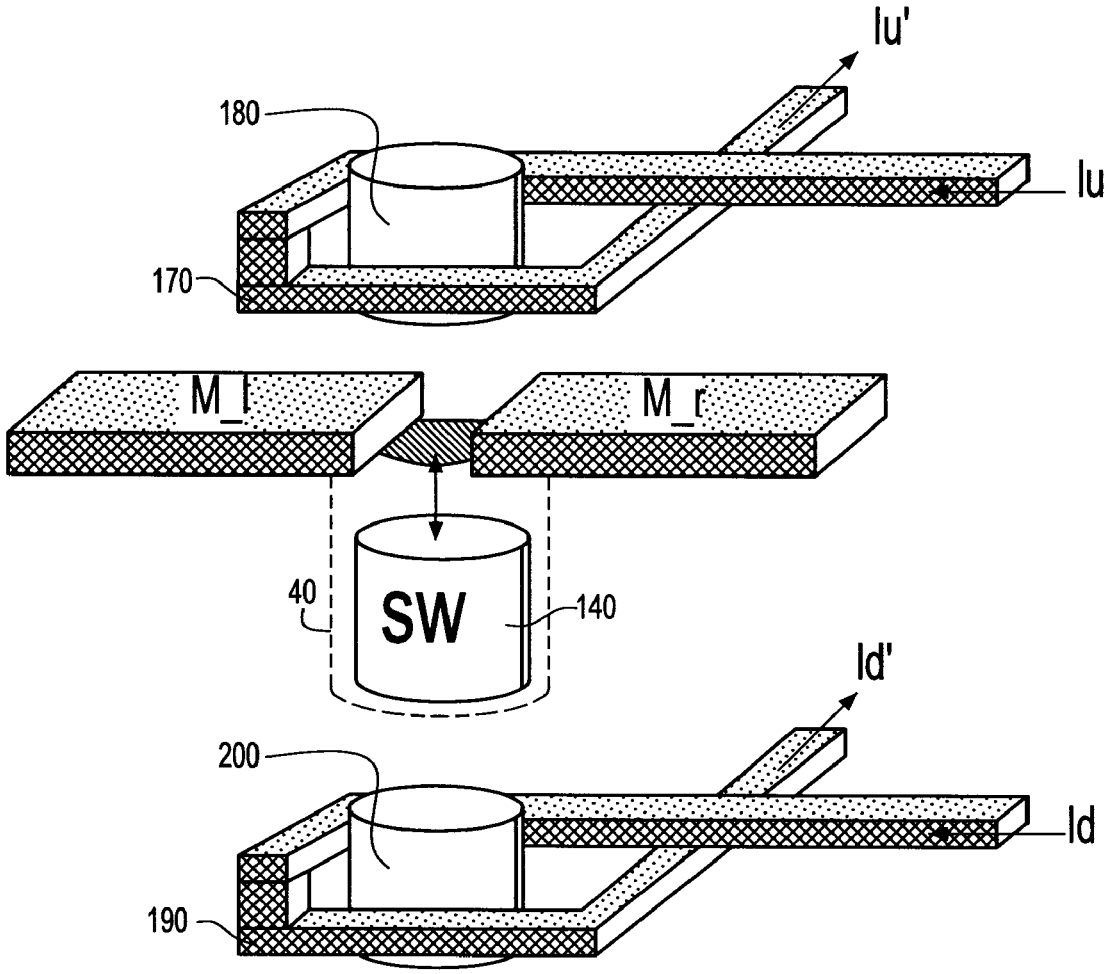
FIG. 1 is a schematic diagram of the MC-MEMS in accordance with the present invention.

FIG. 1 is a schematic diagram showing a perspective view of MC-MEM switch of the present invention.

The MC-MEMS is illustrated showing the following basic elements: (1) an upper inductive coil 170, an optional lower inductive coil 190; (2) an upper a core 180, an optional lower core 200 preferably made of permalloy, (3) a micro-cavity 40, and (4) a switching element 140 freely moving therein (hereinafter SW) preferably made of magnetic material. Switching is activated by passing a current (Iu) through the upper coil, inducing a magnetic field in the coil element 170. In such an instance, the lower coil 190 is disabled (no current passes through the lower coil, i.e., Id=0). The magnetic field attracts the free-moving magnetic element 140 upwards, shorting the two individual wire segments M_l and M_r. When the current flow stops or is reversed, the free-moving magnetic element 140 drops back by gravity to the bottom of the micro-cavity, opening the wire and turning off the MC-MEM switch.

The cavity has preferably a cylindrical shape, with a diameter in the range from 0.1 to 10 μm. The cavity will alternatively also be referred hereinafter as a micro-cavity since its diameter approximates the diameter of a conventional metal stud used in a BEOL.

It has been assumed thus far that the chip is properly mounted in an upright position, allowing gravity to be used for opening the circuit. Thus, one may dispense from having a lower coil. However, when the chip is not mounted in an upright position, gravity cannot be used. In such an instance, a second coil, referenced lower coil 190, becomes necessary to pull SW back, and hold it at its original position. Accordingly, during switching, the upper coil 170 is disabled (i.e., Iu=0) and the lower coil 190 is activated by passing through a current (Id).

As previously stated, the free-moving conductive element SW is preferably a permalloy core, or a permalloy core with a copper coating for better electrical conductivity. Practitioners of the art will readily recognize that permalloy is an iron -nickel based alloy having a high magnetic permanence, and widely used in the magnetic storage industry. The permalloy material may also contain small amounts of Co, V, Re, and/or Mn. Furthermore, it can be deposited by physical sputtering or electro-deposition, as described in U.S. Pat. No. 4,699,702; in U.S. Pat. No. 6,656,419B2; and U.S. Pat. No. 6,599,411. Small amount of other elements such as Co, V, Re, and/or Mn can be added to enhance the performance of the soft magnetic properties of the nickel-iron base permalloy. The inductive element can be interchangeably shaped as a sphere, cylinder, or any other shape having a maximum cross-sectional area smaller than the diameter of the micro-cavity.

When current is applied to inductor 170, a magnetic field is induced to the 140 moving conductive element as well as to the upper core 180, attracting them towards each other. The free moving element 140 short-circuits the top electrodes M_l and M_r, closing the switch). When the current stops flowing, the magnetic field disappears, and the moving element 140 drops back to the bottom of the cavity by gravity, opening the switch.

In a second embodiment, the core 180 acts as a permanent magnet. Depending on the direction of the current, the polarity of inducing the free moving conductive element 140 equals or is opposite to the permanent magnet core 180. As a result, the free moving conductive element 140 will either attract or repulse the upper core 180. The ensuing switch then closes or opens accordingly.

In still another embodiment, two sets of coils with their respective cores are coupled to the free moving switch element 140. Both the cores and SW 140 are preferably made of permalloy. Therefore, upper coil 170 can be activated to attract the element upward at a first instant of time. Similarly, the bottom coil 190 can be activated at a second instant time to bring SW 140 down. Based on the same principle, other combinations of switching operation are possible.

Following is a discussion of the fabrication process steps necessary to manufacture the MC-MEM switch in a CMOS manufacturing line.

Figure 2:
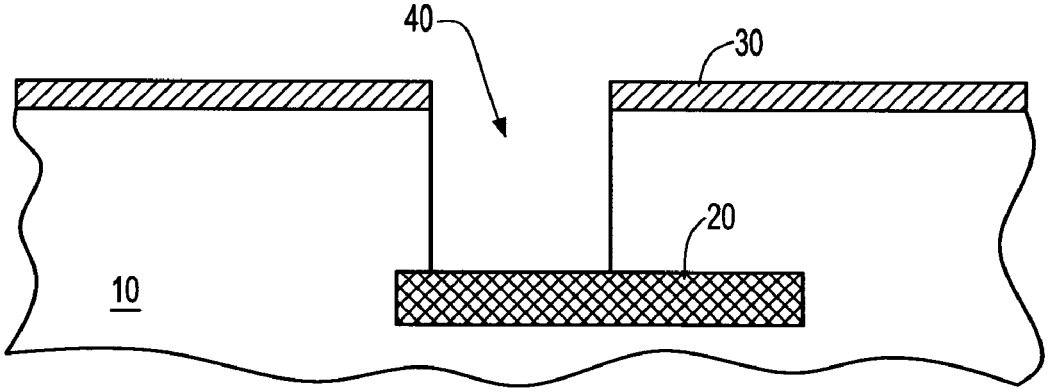
FIGS. 2 through 17 are schematic diagrams illustrating the various fabrication steps to construct the MEM device of the invention.

Referring to FIG. 2, a substrate 10 is insulated by way of protective film 30, preferably using a chemical vapor deposition (CVD) nitride. An etch stop layer 20, irrespective whether conductive or not, is formed by a normal process, including deposition and patterning. A cavity 40 is then formed in the substrate, stopping at the etch stop layer 20.

Figure 3:
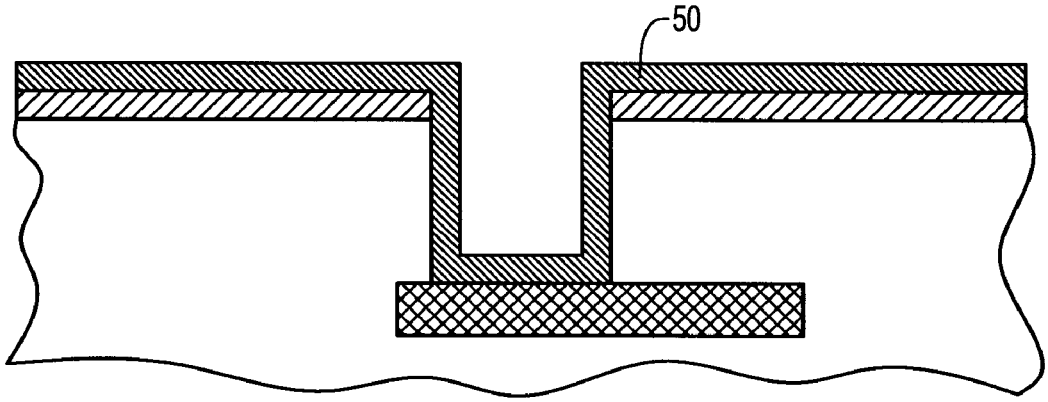

Referring to FIG. 3, a buffer (or sacrificial) material 50 is blanket deposited. The thickness of the film is determined by how much tolerance between the free-moving switch element (not shown) to the sidewall of the cavity is allowed to leave an adequate gap between the sidewall of the micro-cavity and the free moving element to be formed. Preferably, the range for the width of the gap is of the order of 0.1 μm or less. The sacrificial material is preferably CVD polysilicon, amorphous silicon which can be selectively removed against the surrounding insulating material. These materials can be dry or wet etch away with high selectivity to the oxide.

Figure 4:
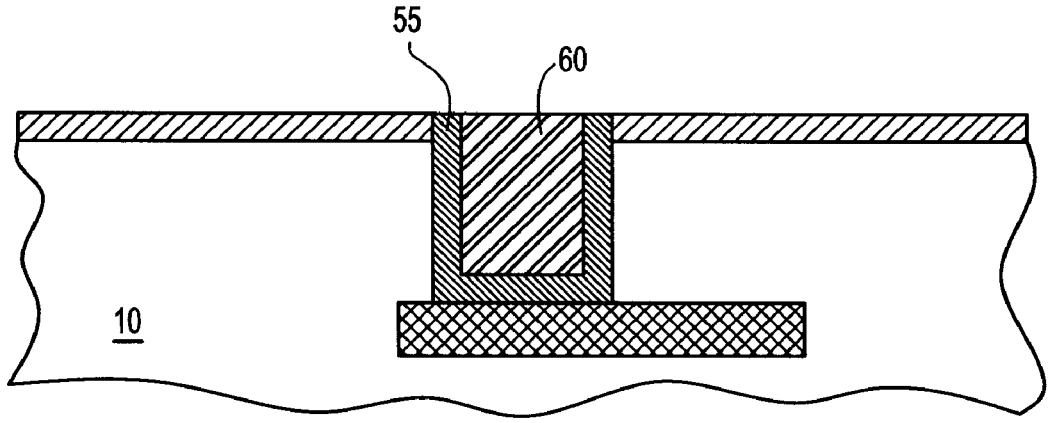

Referring to FIG. 4, conductive material 60 is preferably made of permalloy, such as an iron-nickel based alloy which is deposited in the cavity, and which is followed by planarization, leaving the cavity fully filed. The buffer layer 50 at the surface is removed during a subsequent chem-mech polishing process. The buffer layer 55 remains only inside the cavity.

Figure 5:
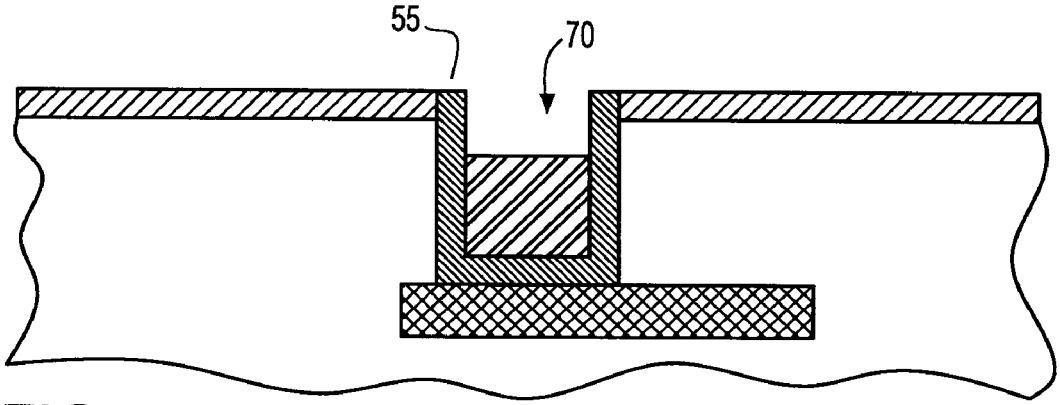

In FIG. 5, the conductive material deposited is recessed to a predetermined level 70, preferably to 70% or 80% of the height of the cavity.

Figure 6:
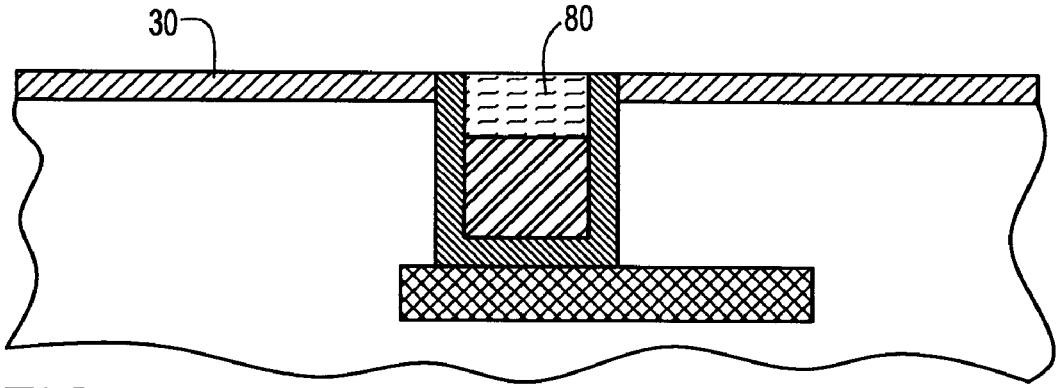

In FIG. 6, the same buffer material that was used on the sidewalls of the cavity is deposited 80, and again polish back that fills the top of cavity.

Figure 7:
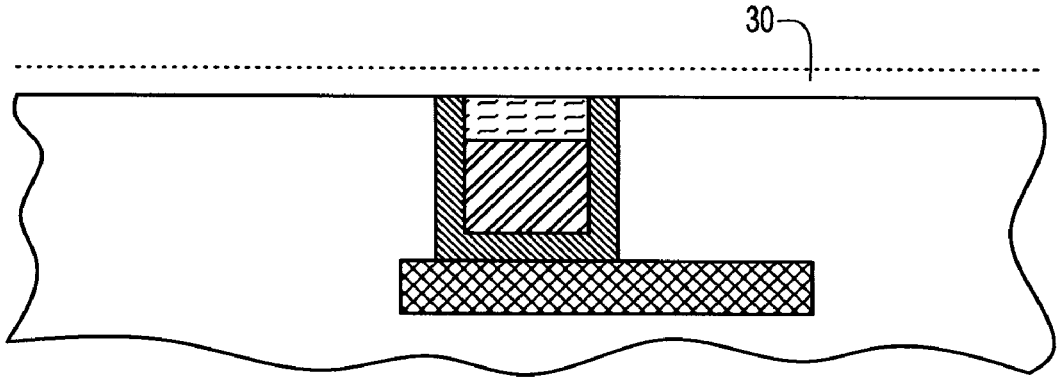

In FIG. 7, protective material 30 is polished back and preferably removed.

Figure 8:
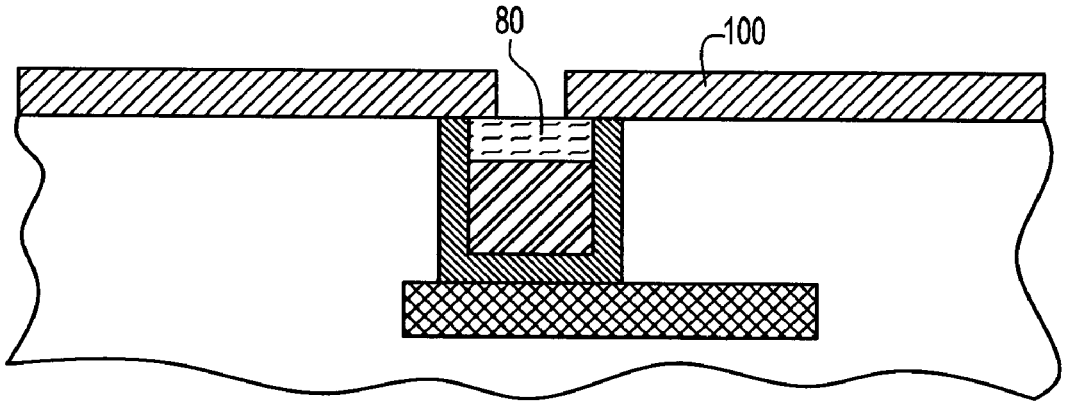

In FIG. 8, metal wiring 100 is formed, using any conventional metallization process, such as metal deposition, patterning, and etching.

Figure 9:
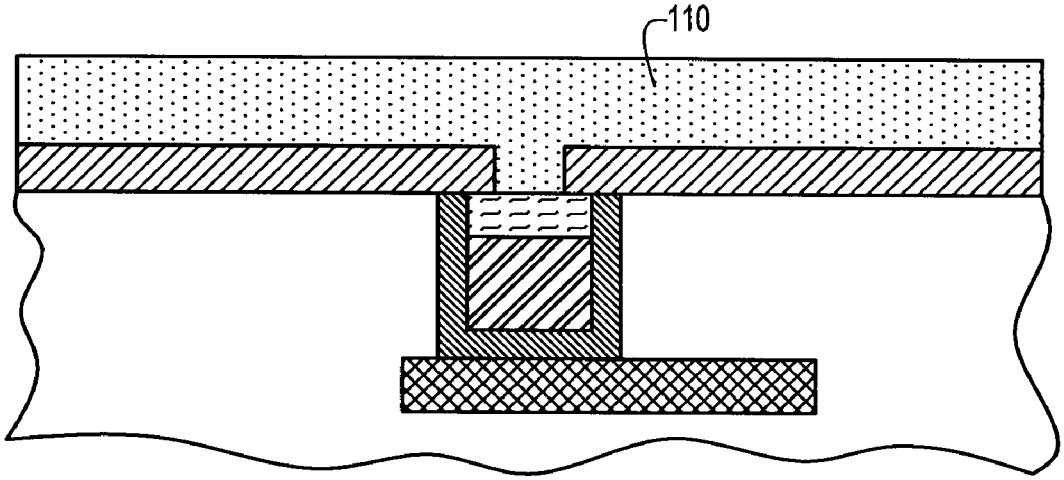

In FIG. 9, a layer of insulating material 110 is deposited, e.g., CVD oxide, spin-on glass, and the like.

Figure 10:
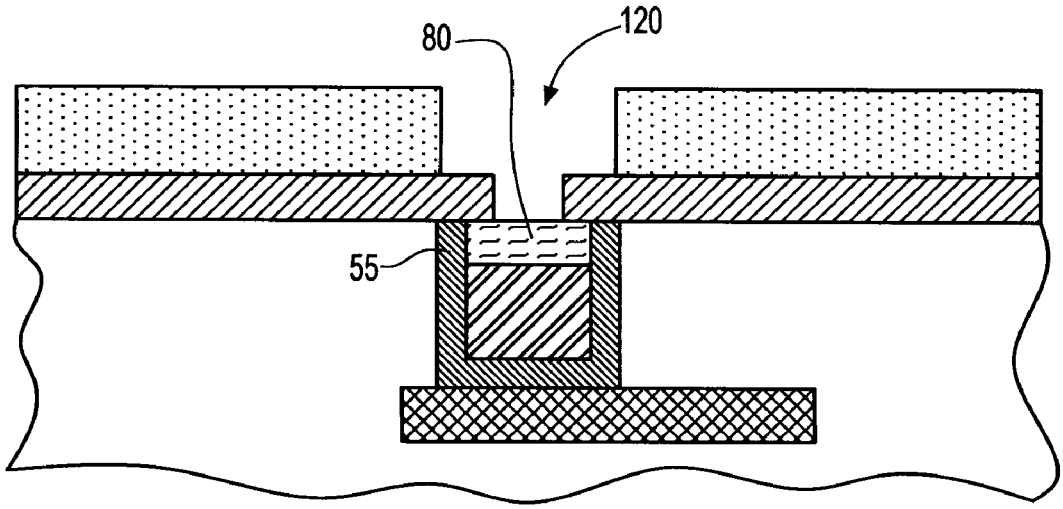

In FIG. 10, a hole 120 in the insulating material 110 is patterned and etched, reaching the top 80 of the micro-cavity.

Figure 11:
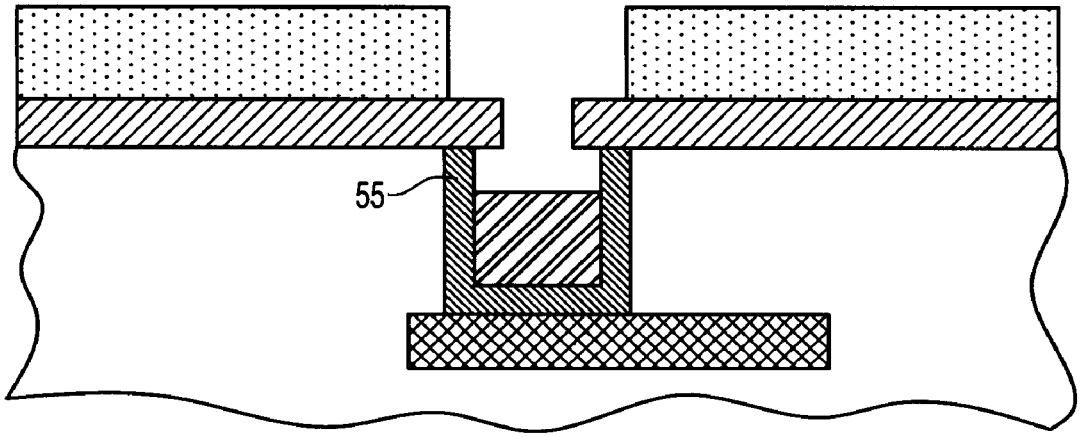

Referring to FIG. 11, buffer material 80 at the top of the cavity is selectively removed.

Figure 12:
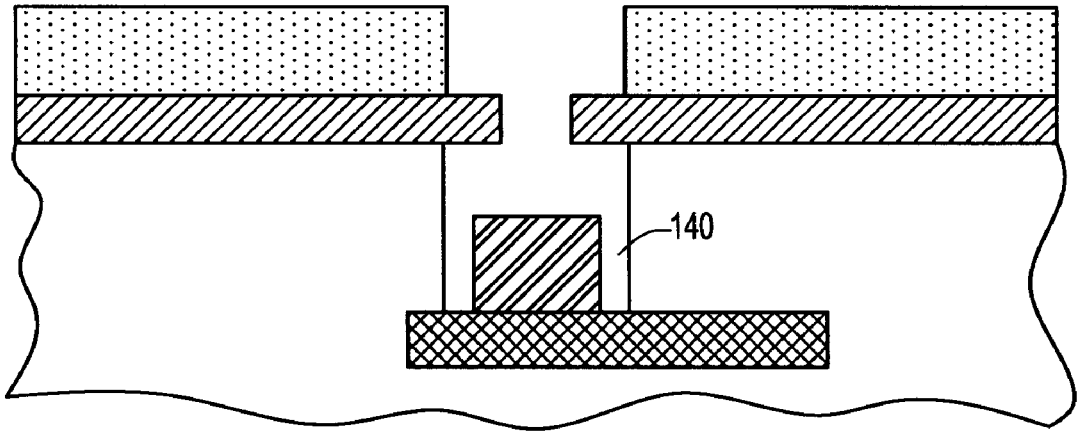

In FIG. 12, the remaining buffered material 55 is removed from the sidewalls of the micro-cavity by way of a conventional selective dry or wet etching.

Figure 13:
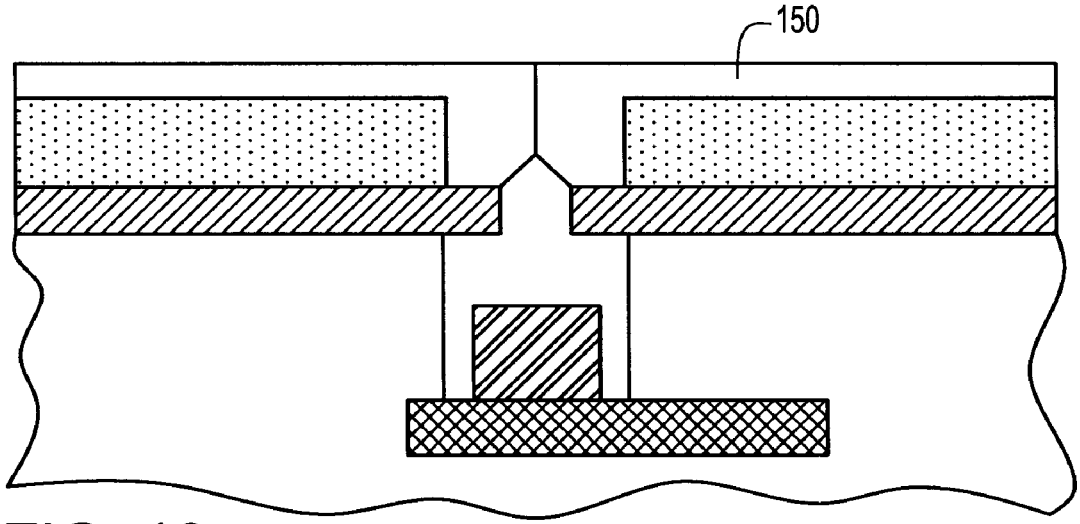

In FIG. 13, the top portion of the hole is sealed by way of insulating material 150 deposited on top of the structure. This deposition is done by chemical vapor deposition using high deposition rates and pressures and low or unbiased source/electrode powers. The high deposition rates (greater than 5000 Å/sec) and pressures (greater than 100 mTorr) limit the mean free path of the reacting species and prevent them from depositing in the cavity. As know to those skilled in the art, low and or unbiased source/electrode powers (less than 100 W) limits the amount of corner rounding on top of the cavity which further inhibits the deposition of the reacting species in the cavity.

Figure 14:
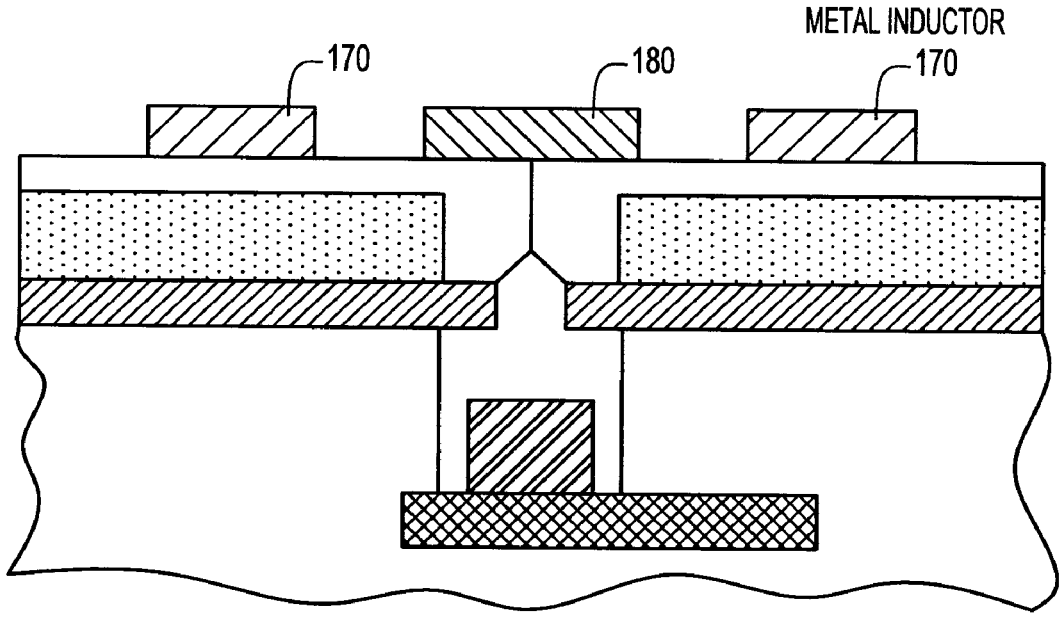

Referring now to FIG. 14, a coil and core element are formed separately using conventional deposition, patterning and etching process. The core material is made of permalloy material, preferably of nickel, copper, titanium or molybdenum. The coil is made of any conventional metal such as aluminum, copper, tungsten or alloys thereof. The fabrication steps are as follows: a thin-film permalloy material is first deposited, and is followed by patterning the permalloy thin-film. Patterning is advantageously accomplished by a Damascene process wherein insulating material is first deposited and followed by an etch step to form the core pattern. It is then filled with core material and polished-back to fill-in the pattern. The same insulating material is then patterned to form coil patterns and is followed by a metal deposition and polish back to fill the coil patterns.

Figure 15:
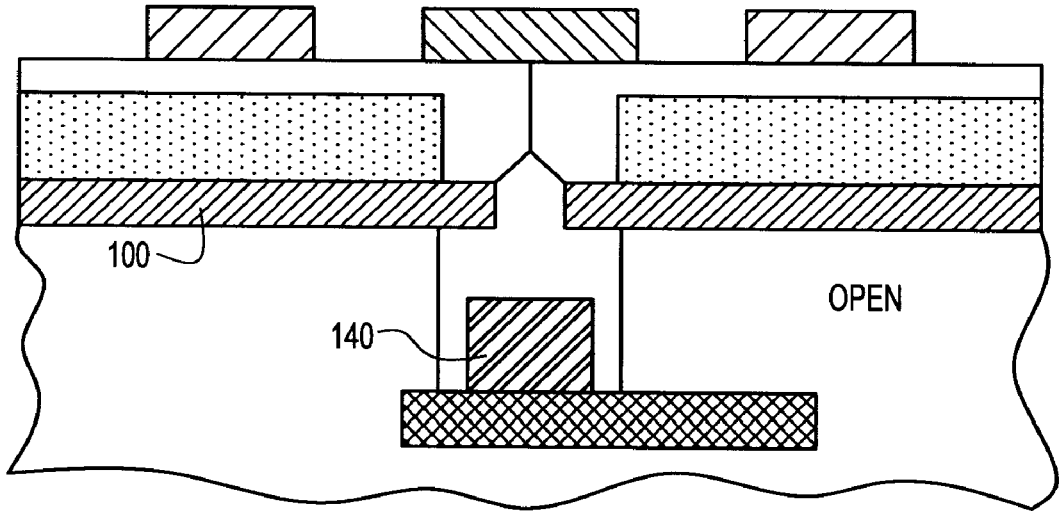

FIG. 15 shows the MC-MEM switch in an open state, with the conductive switching moving element 140 shown at the bottom of the cavity.

Figure 16:
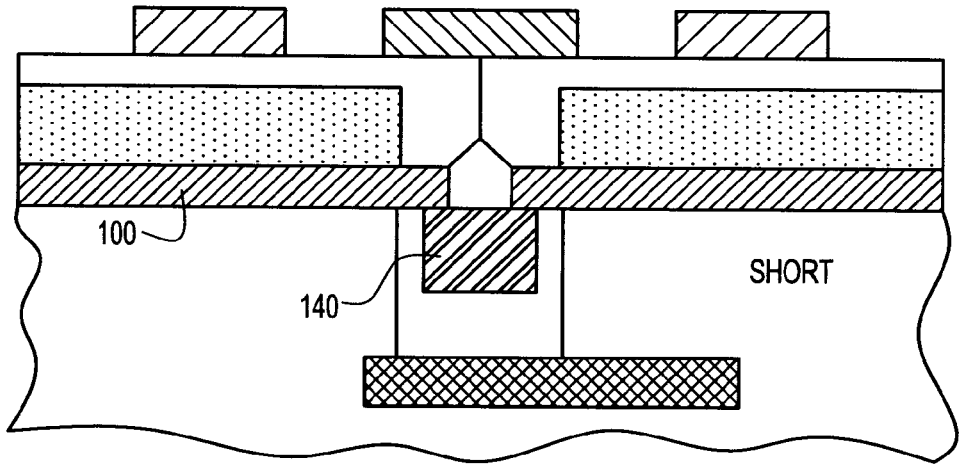

FIG. 16 shows the same MC-MEM switch shorting the two wires 100, which is achieved by the conductive free moving switching element 140 being pulled up by a magnetic field. Buffered material is etched away as shown in FIG. 12, in order that SW should not become 'glued' to the bottom of the micro-cavity.

Figure 17A:
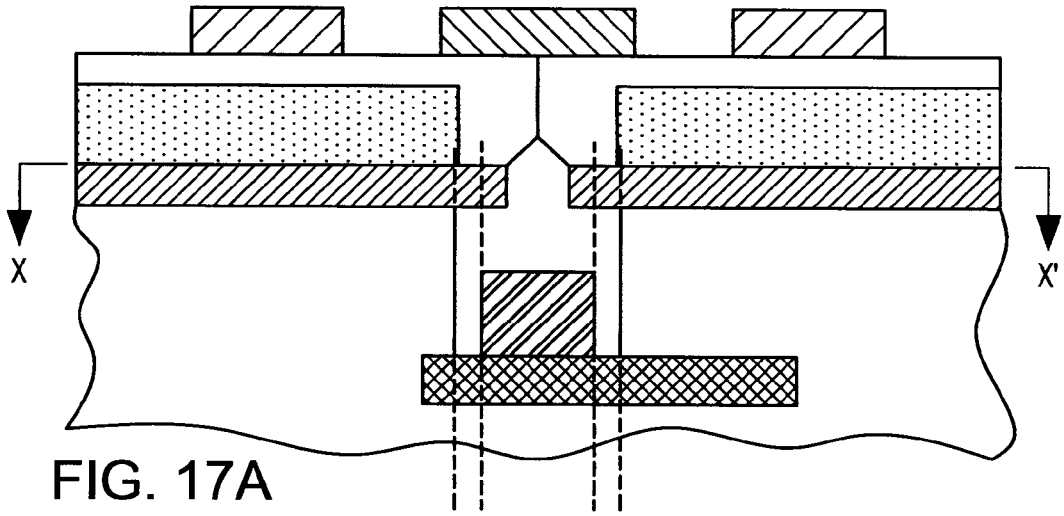
Figure 17B:
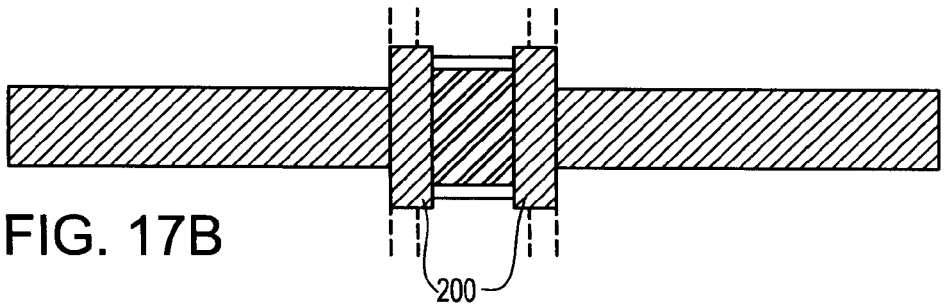
Figure 18:
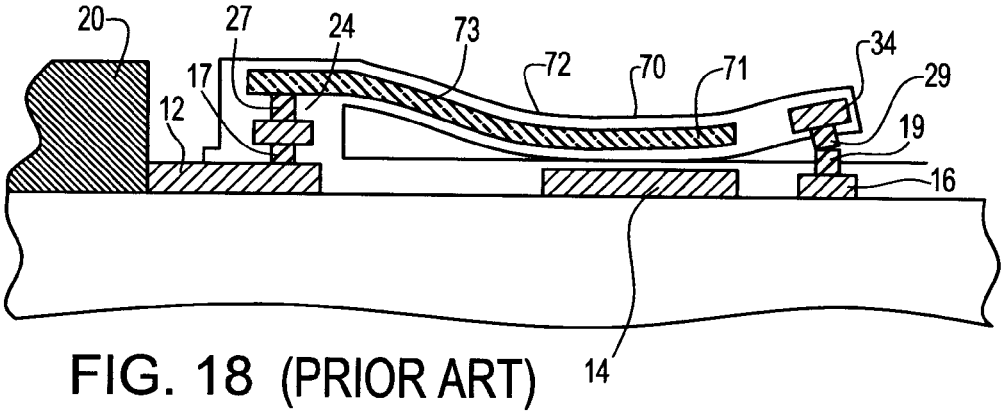
FIG. 18 (PRIOR ART)
FIG. 18 shows a prior a cantilever type MEM switch.
Figure 19A:
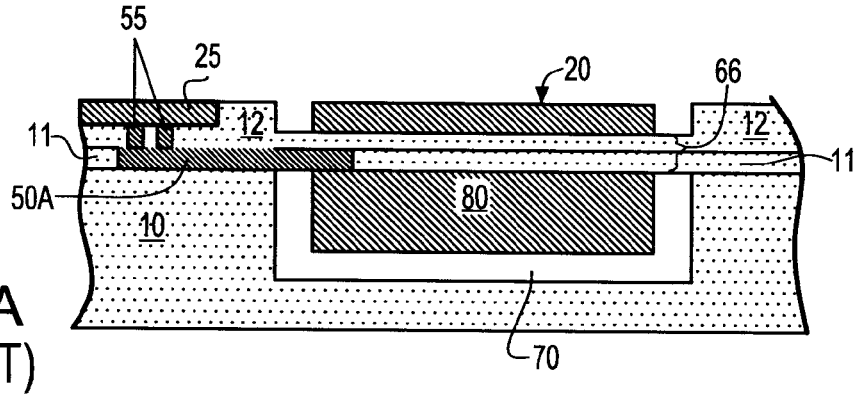
FIG. 19A (PRIOR ART)
FIGS. 19A-19B respectively show a cross-section and a top-down view of a prior art perpendicular torsion micro-electromechanical switch.
Figure 19B:
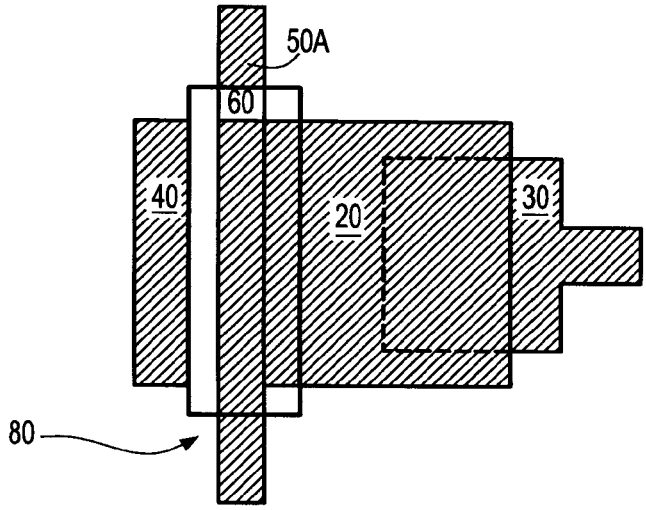
FIG. 19B (PRIOR ART)
Figure 20:
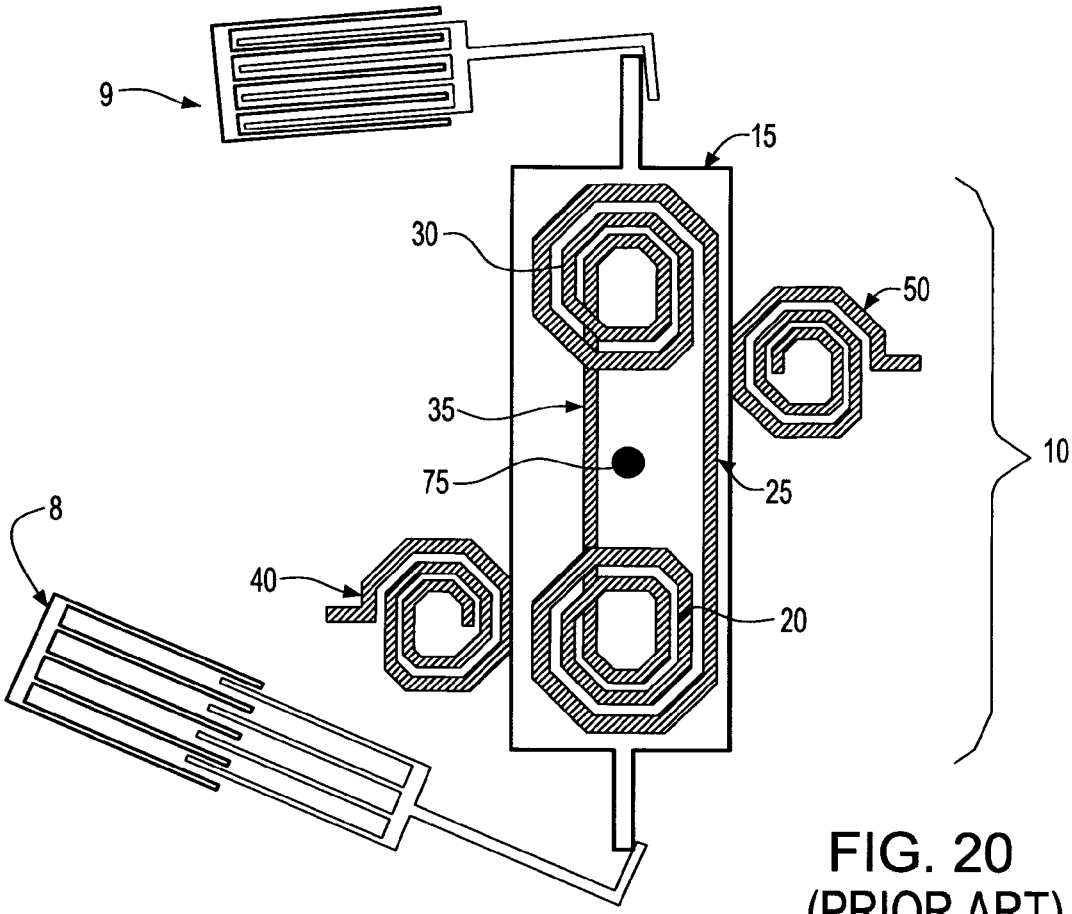
FIG. 20 (PRIOR ART)
FIG. 20 shows a prior art micro-electromechanical inductive coupling force MEM switch.
Figure 21:
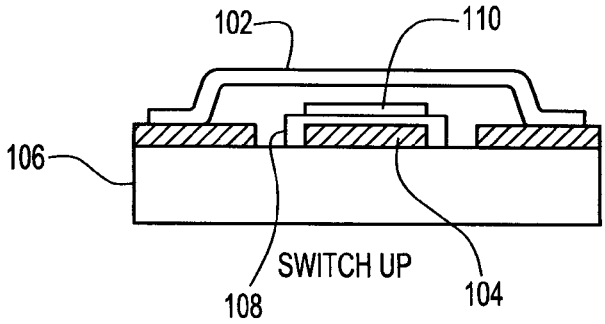
FIG. 21 (PRIOR ART)
FIG. 21 illustrates a prior art capacitive membrane MEMS device.
Figure 22A:
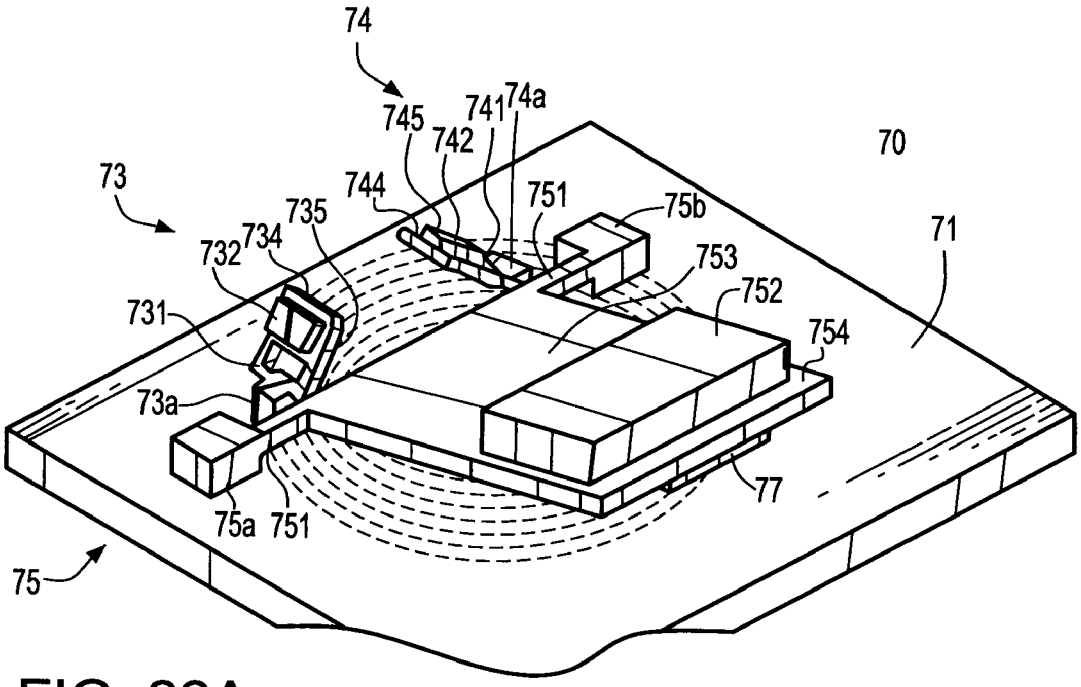
FIG. 22A (PRIOR ART)
FIGS. 22A-22B respectively illustrate a perspective view and a side view of a conventional magnetic coupling for providing an angular displacement for actuating micro-mirrors.
Figure 22B:
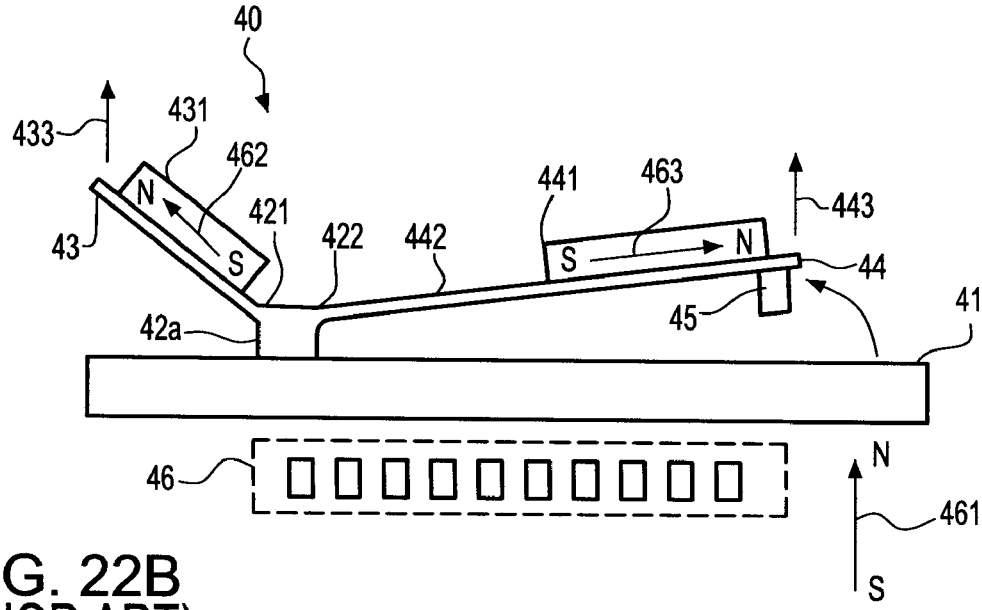
FIG. 22B (PRIOR ART)

FIGS. 17A and 17B respectively show a side view and a corresponding top-down view along line X-X' of the final MC-MEMS structure.

The opening to the micro-cavity in FIG. 17B is shown to be partially shadowed by the metal wires. The additional metal extension pieces 200 serve two purposes, (1) to block out residue during top sealing process, (also referred to shadowing effect), and (2) to provide more electrical contact area for the switch element. It is conceivable that one may pattern the metal wires in such a way that a full shadowing effect can be achieved to avoid residue being deposited inside the cavity.

The micro-cavity of the present invention is about the same size as a conventional metal stud. The free-moving switch element inside the cavity is preferably sealed in vacuum and thus free from corrosion.

Unlike prior art MEM switches, there is no mechanical moving hinge elements and thus the device is more robust and durable. Since the cavity is fully encapsulated and sealed, a subsequent planarized surface offers further capability of integration or assembly. The MC-MEMS as described is fully compatible with conventional CMOS semiconductor fabrication process steps.

In order to better quantify the various parameters of the MEM switch of the present invention, the following estimation of the magnetic field and coil size of the MC-MEMS will be discussed hereinafter.

The energy or work that is required to move the free-moving elements for a certain distance is given by the equation:

$$\text{Energy}=\tfrac{1}{2}LI^2=(mg(1+\epsilon))h$$

wherein:

$\epsilon$, coefficient of friction=0.1 m, mass of the switch element h, height of the traveling distance: 0.5 μm

H, height of the cylindrical switch element=0.5 μm

D, diameter of the cylindrical switch element=1 μm g, coefficient of gravity: 9.8 m/s$^2$ L, inductance (Henry)

I, current to generate magnetic (Amp).

The mass of the free moving element is estimated to be as follows:

Density of the Aluminum and alloy is about 2.7 g/cm$^3$.

Volume of the moving element is given by the equation:

$$V=\pi(d/2)^2H=(3.14)(0.25)(0.5)=0.39E{-}12\ \text{cm}^3.$$

The mass of the moving element is $$M=2.7\times0.39E{-}12=1.05E{-}12\ \text{g}.$$

The estimated work is $$\text{Work}=(mg(1+\epsilon))h=(1.06E{-}12)\times9.8\times1.1(0.5E{-}6)$$
$$=5.7E{-}18\ \text{gm}^2/\text{s}^2=5.7E{-}21Nm=5.7E{-}21J.$$

The size of the inductor is estimated to be:

$$\tfrac{1}{2}L^2=5.7E{-}21J.$$

Current I is calculated as:

$$I=0.1\ \text{mA}=1E{-}4A(\text{or } 1\ \text{mA}=1E{-}3A).$$

Then, the spiral inductance $$L=(2\times5.7E{-}21)/1E{-}4)^2=1.14E{-}11=10pH(\text{or } 0.01nH).$$

Note that a coil having a high μ-core can boost the magnetic field by a factor of 10 or more such that the required current level (I) can be lowered by 10×.

Modified Wheeler Formula $$L_{mw} = K_1\mu_0\frac{n^2 d_{avg}}{1+K_2\rho}$$

$K_1$=2.34
$K_2$=2.75
n=number of turn=1
$d_{avg}$=average diameter=0.5(din+dout)
p=fill ratio=(dout-din)/(dout+din)
$u_o$=permeability of air=1.26 E-6

1) For a single turn,
din=1 μm, and dout=2 μm
$d_{avg}$=1.5 μm,
ρ=0.34
L=(2.34×1.26 E-6×(1×1.5 E-6))/(1+2.75×0.34)=1.90 pH (2) For a double turn,
din=1 μm, dout=4 μm
$d_{avg}$=2.5 μm
ρ=0.6
L=(2.34×1.26 E-6×(4×2.5 E-6))/(1+2.75×0.6)=11.12 pH.

If 1 mA of current is used, a coil having 1 turn with an inner diameter of 1 μm, turn width and space of 0.5 μm should be adequate. If the inductor current is reduced to 0.1 mA, a double turn inductor is required. The current and size of the coil of both situations are acceptable for semiconductor applications.

While the present invention has been particularly described in conjunction with specific embodiments, it is evident that other alternatives, modifications and variations will be apparent to those skilled in the art in light of the present description. It is therefore contemplated that the appended claims will embrace any such alternatives, modifications and variations as falling within the true scope and spirit of the present invention.

What is claimed is:

1. A method of forming a micro-electromechanical (MEM) switch comprising:

forming on a substrate at least one inductive coil surrounding an inductive element; and etching a micro-cavity in said substrate having an opening substantially aligned with said inductive element, said inductive element moving freely within said cavity to a first position when energized by said at least one inductive coil, electrically shorting two conductive wires, and to a second position when de-energized, opening said two shorted conductive wires, said inductive element when de-energized falling from said first position to said second position by gravity, wherein forming said inductive element further comprises:

conformally depositing sacrificial material on sidewalls of said micro-cavity to a thickness that is determined by a tolerance between the free-moving inductive element to the sidewalls of said micro-cavity;

depositing conductive material in said micro-cavity;

planarizing back to fill said micro-cavity;

recessing said conductive material to a predetermined level of the height of said micro-cavity;

refilling said micro-cavity with sacrificial material to a top surface of said microcavity; and selectivity removing said sacrificial material to free said conductive material from said sidewalls of said micro-cavity.

2. The method as recited in claim 1, comprising forming said inductive element of permalloy.

3. The method as recited in claim 1, further comprising:

depositing conductive material within said micro-cavity;

planarizing said conductive material, leaving said micro-cavity filled to a predetermined height of said micro-cavity; and filling said micro-cavity with sacrificial material.

4. The method as recited in claim 3 further comprising:

selectively removing said sacrificial material from the top surface of said micro-cavity; and forming conductive wires and depositing thereon insulating material.

5. The method as recited in claim 4 further comprising:

patterning and etching an aperture reaching said micro-cavity; and selectively removing said sacrificial material from the top surface of said micro-cavity and from the sidewalls thereof.

6. The method as recited in claim 5 further comprising sealing the top surface of said micro-cavity.

7. The method as recited in claim 4 further comprising patterning said conductive wires including conductive wire segments that are separate from each other, wherein said separation is substantially aligned with said inductive element, allowing said inductive element to short and open said wire segments when said inductive coil is respectively energized and de-energized.

8. The method as recited in claim 7, wherein said energizing and de-energizing said inductive element is achieved by applying a current to said coil to induce a magnetic field on said inductive element, attracting said inductive element toward said magnetic coil, said inductive element short-circuiting said conductive wires.

9. The method as recited in claim 8, further comprising disabling said current to neutralize said magnetic field, allowing gravity to drop said inductive element to the bottom of said micro-cavity.

10. The method as recited in claim 8, further comprising moving said inductive element within said micro-cavity guided by upper and lower inductive coils at opposite surfaces of said micro-cavity.

11. The method as recited in claim 8, further comprising forming said micro-cavity having a cylindrical shape with a diameter ranging from 0.1 to 10 μm. and a height ranging from 0.1 to 10 μm.

12. The method as recited in claim 8, further comprising shaping said inductive element as a sphere, cylinder, or a shape having a maximum cross-sectional area smaller than the diameter of said micro-cavity.

13. The method as recited in claim 8, further comprising forming said inductive element as a metallic coil having N turns, N being greater or equal to 1, said inductive element being positioned within said inductive coil.

14. The method as recited in claim 13, further comprising forming said inductive coil of a material selected from a group consisting of Al, Cu, Ti, Ta, Ni, W, and any alloy thereof.

15. The method as recited in claim 8, further comprising forming said inductive element of permalloy, wherein said permalloy is an iron-nickel based alloy combined with amounts of a material selected from a group consisting of Co,V, Re, and Mn.

* * * * *